United States Patent [19]

Beckers

[11] Patent Number: 5,038,977

[45] Date of Patent: Aug. 13, 1991

[54] PAIR OF REFRACTORY BLOCKS FOR A ROTARY SLIDE VALVE CLOSURE

[75] Inventor: Dieter Beckers, Neunkirchen-Seelscheid, Fed. Rep. of Germany

[73] Assignee: Martin & Pagenstecher GmbH, Köhn-Mülheim, Fed. Rep. of Germany

[21] Appl. No.: 455,610

[22] Filed: Dec. 22, 1989

[30] Foreign Application Priority Data

Dec. 23, 1988 [DE] Fed. Rep. of Germany ..... 3843456
Jan. 14, 1989 [DE] Fed. Rep. of Germany ..... 3900961

[51] Int. Cl.[5] ..... B22D 41/08
[52] U.S. Cl. ..... 222/599; 222/591
[58] Field of Search ..... 222/597, 598, 599, 591, 222/555

[56] References Cited

U.S. PATENT DOCUMENTS 3,710,992 1/1973 Hoffmann ..... 222/598
3,760,992 9/1973 Bieri ..... 222/598
4,728,012 3/1988 Monks ..... 222/598

FOREIGN PATENT DOCUMENTS 3842121 6/1989 Fed. Rep. of Germany ..... 222/598

*Primary Examiner*—S. Kastler
*Attorney, Agent, or Firm*—Michael J. Striker

[57] ABSTRACT

The refractory block arrangement for a rotary slide valve closure for metal melt containers having a bottom discharge, which arrangement comprises a refractory top block; a refractory rotatable frustoconical discharge block having a discharge flow channel having a vertical central axis that coincides with the central axis of the flow channel of the top block, and an axis of rotation extending at an acute angle to the vertical central axis of the discharge flow channel and intersecting the vertical central axis at a point lying in a cross-sectional plane of the discharge opening; and further comprising a drivable annular entraining casing rotatably supported in the slide valve casing of the rotary slide valve closure for supporting the frustoconical discharge block. To provide an automatic adjustment for manufacturing tolerances in the discharge blocks while minimizing the pressing force at the contacting surfaces and providing a compact structure the frustoconical discharge block is provided with a spherically-shaped peripheral surface portion engaging a corresponding surface in an adjustable annular entraining casing.

5 Claims, 4 Drawing Sheets

PAIR OF REFRACTORY BLOCKS FOR A ROTARY SLIDE VALVE CLOSURE

The invention relates to a pair of refractory blocks for a rotary slide valve closure, having a pivotable and closable slide valve casing, on metal melt containers formed with a bottom discharge opening, comprising a top block having a sealing and sliding surface inclined to the horizontal and a flow channel with a vertical central axis, and a rotatable, frustoconical discharge block having a flow channel with a vertical central axis and disposed in a drivable annular entraining casing which is rotatably disposed in the valve casing of the rotary slide valve closure, the axis of rotation of the discharge block forming an acute angle with the vertical central axis of the flow channel, and the point of intersection of the axis of rotation with the central axis of the flow channel lying in the cross-sectional plane of the discharge opening of the flow channel in the discharge block.

In the customary rotary slide valve closure with a vertical axis of rotation the problem arises that when the slide valve plate is adjusted in the direction of heavier or lower throttling, the discharge opening and therefore the position of the emerging stream are displaced laterally together with the slide valve plate. In contrast, when the slide valve plate rotates around its axis in the closure according to the invention, the opening of the flow channel situated on the inside is guided in the arc of a circle and completely or partially opens or closes the flow channel, while the discharge opening maintains its position, so that the emerging stream of melt does not shift. This is advantageous in all casting operations in which the pouring stream must not shift, for example, when casting into a continuous chill mould or when introducing the stream of metal into the mould pouring gate in the production of shaped castings.

A pair of refractory blocks of the kind specified is known from German AS 20 43 588, which relates to a rotary slide valve closure. The top and discharge blocks of the pair of refractory blocks, which are referred to as a perforated plate and a slide valve plate in German AS 20 43 588, are disposed in a slide valve casing comprising a casing upper part and a casing lower part interconnected via a screwed connection. The rigid arrangement of the perforated plate and the slide valve plate in the slide valve casing probably makes it difficult to achieve an even bearing of the sealing and sliding surface of the perforated plate and the slide valve plate, more particularly since refractory members may have dimensional tolerances due to manufacture.

Figure 1:
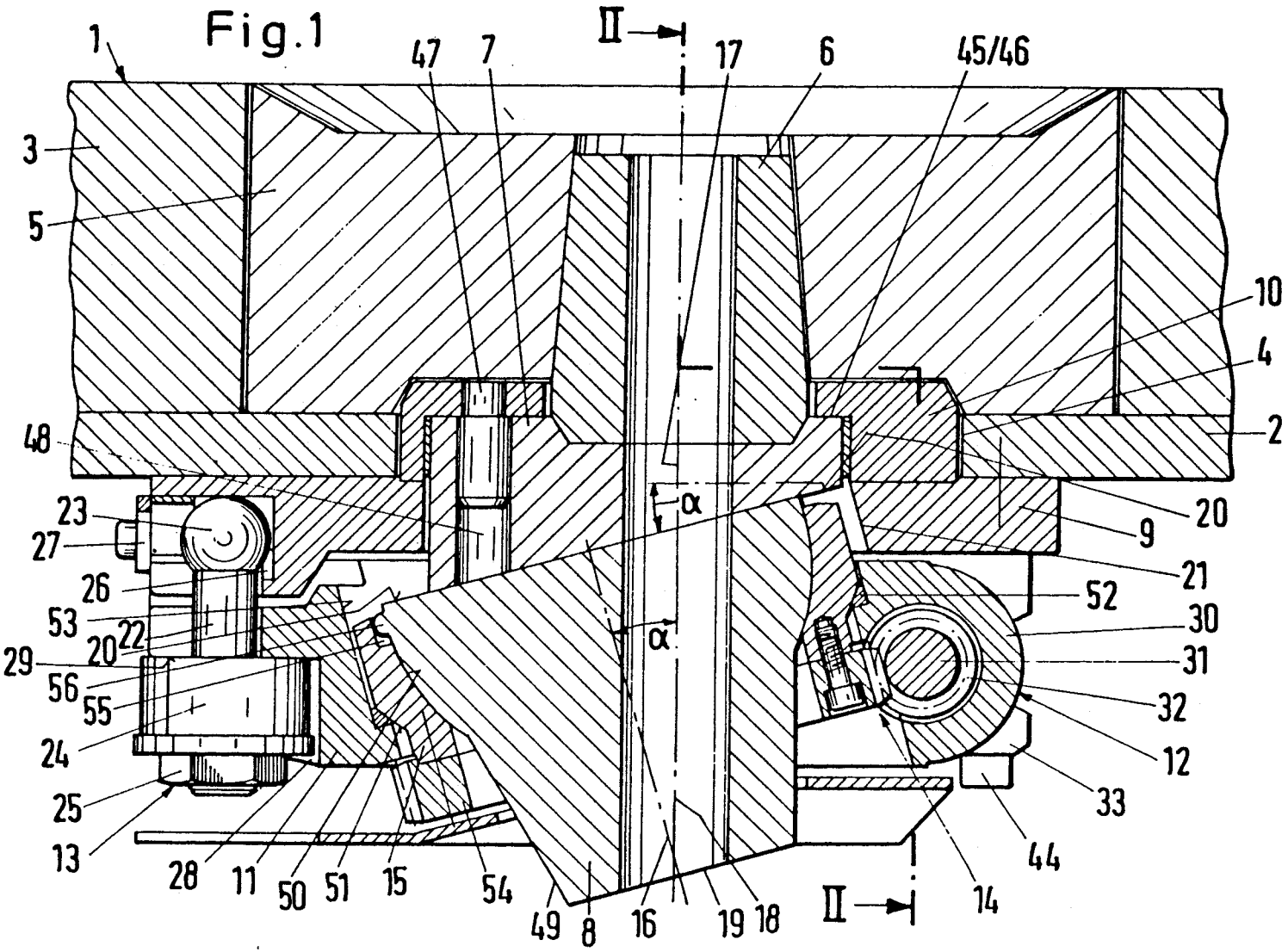

Another disadvantage is that the rotatable slide valve plate has an elongate, frustoconical shape, the angle between the axis of rotation and the vertical central axis of the flow channel being 7°, as can be seen in FIG. 1 of German AS 20 43 588. This construction results as a whole in a considerable overall height of the rotary slide valve closure which limits its possible applications. Another disadvantage is that the perforated plate is borne on the lower portion of the casing. Since the static pressure of the melt rests directly on the perforated plate, excessive surface pressures occur at the contact surface with the lower portion of the casing, with the consequent risk that the refractory perforated plate may be destroyed.

It is an object of the invention so to construct a pair of refractory blocks of the kind specified that the aforedescribed disadvantages are obviated, using a rotary slide valve closure which is not prior art and has a pivotable and closable slide valve casing on metal melt containers formed with a bottom discharge opening, the rotatable, frustoconical discharge block being disposed in a drivable annular entraining casing which is rotatably disposed in the slide valve casing of the rotary slide valve closure. Other particular objects of the invention are to provide a uniform bearing of the sealing and sliding surfaces of the top block and the discharge block, and to achieve a shortened length of the discharge block, resulting as a whole in a reduced overall height of the rotary slide valve closure.

This problem is solved by the features of claim 1, namely that portion of the peripheral surface of the discharge block which contacts the annular entraining casing is constructed spherical. This feature ensures that the rotary discharge block bears uniformly against the fixed top block, since the discharge block remains adjustable, even if the top block and the discharge block show dimensional deviations due to manufacture.

Preferably, according to claim 2, the spherical portion of the peripheral surface is disposed in the upper portion below the sealing and sliding surface of the discharge block According to claim 3 the discharge block has, distributed in the spherical portion of its peripheral surface, projections for engaging in recesses in the entraining casing of the rotary slide valve closure. This ensures that the discharge block is firmly seated in the rotating entraining casing during rotary slide valve closure operation.

According to claim 4 the top block is cylindrical and formed with a bore for receiving a locking pin disposed in the rotary slide valve closure.

According to claim 5 advantageously the top block and the discharge block are so constructed that the angle $\alpha$ on the one hand between the axis of rotation of the discharge block and the vertical central axis of the flow channel, and on the other hand between the sealing and sliding surface of the top and discharge blocks to the horizontal, is in the range of 15° to 45°. In this way a shortened length of the discharge block is obtained which as a whole results in a reduced overall height of the rotary slide valve closure. Surprisingly, the preferred range of the angle $\alpha$ leads to optimum sliding and sealing properties between the top block and the discharge block.

According to claim 6 the flow channel of the discharge block has an annular insert in the zone of the discharge opening. As a result it is no longer necessary to form the discharge blocks with flow channels of different diameters adapted to the required flow quantity of the cast metal melt. Different flow quantities can be adjusted by means of the annular insert which is, for example, glued into the flow channel.

Figure 2:
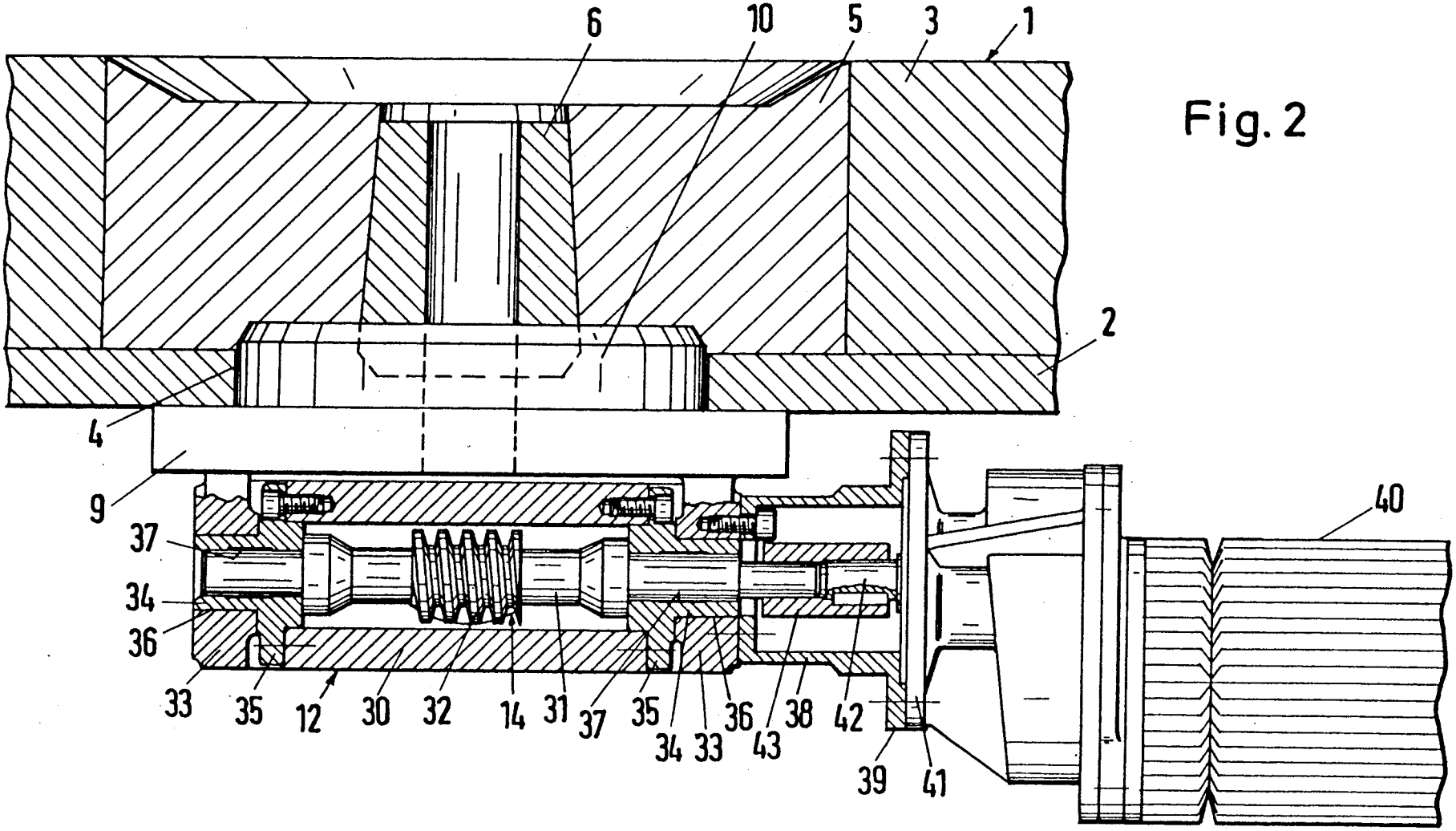
Figure 3:
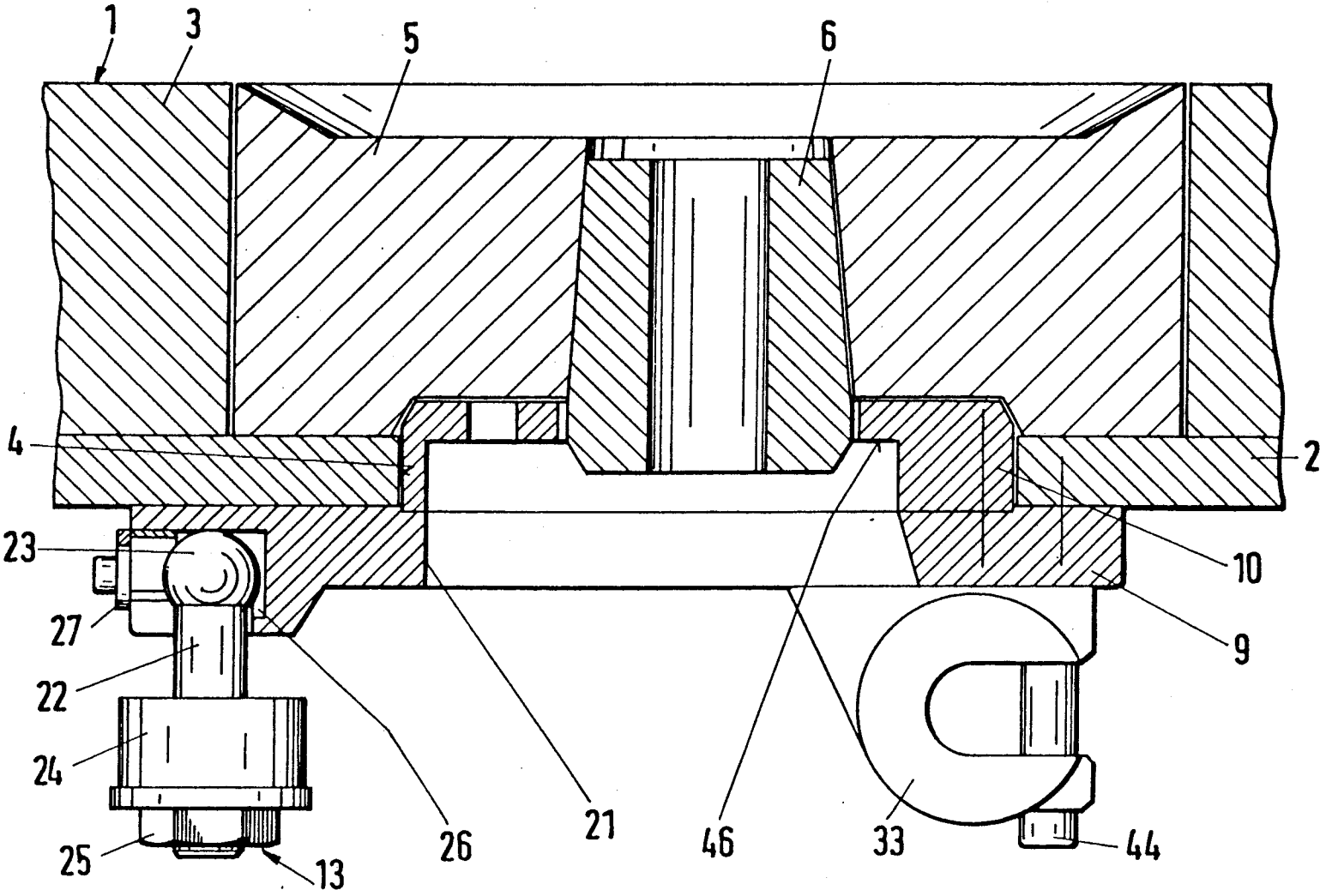
Figure 4:
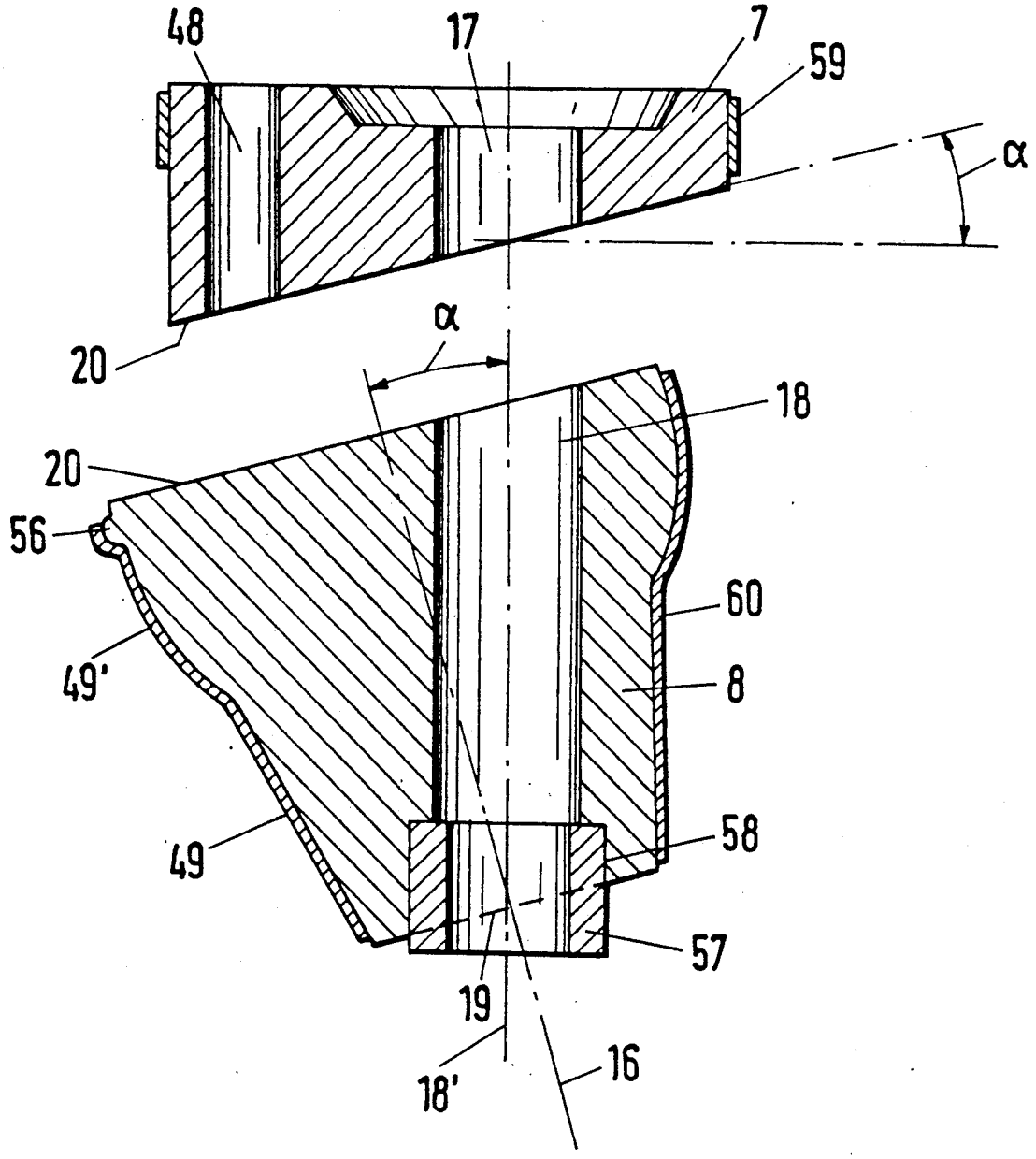

The pair of blocks according to the invention will now be explained in greater detail with reference to the embodiment thereof illustrated in the drawings; the rotary slide valve closure which is not prior art is described. In the drawings:

FIG. 1 is a cross-sectional view of the bottom portion of a vessel and of the rotary slide valve closure, with the pair of refractory blocks according to the invention, FIG. 2 is a cross-sectional view of the joint and drive arrangement, taken along the line II—II, in FIG. 1, FIG. 3 is a cross-sectional view corresponding to FIG. 1, in which the slide valve casing with the pair of refractory blocks is not shown, and FIG. 4 is a cross-section through another embodiment of the pair of refractory blocks according to the invention.

Referring to FIGS. 1 and 3, a rotary slide valve closure is disposed on the bottom of a vessel 1 which can be, for example, a casting ladle, such as is used in steelworks and foundries, or an intermediate vessel, such as is used in continuous casting. The bottom of the vessel 1 comprises an outer metal jacket 2 having a refractory inner lining 3, which has a refractory bottom block 5 with a refractory perforated block 6 in the zone of a flow opening 4 in the metal jacket 2.

As shown more particularly in FIG. 1, the main components of the rotary slide valve closure are a pair of blocks according to the invention, comprising a top block 7 which is retained fixed, and a rotatable discharge block 8, and also an assembly plate 9 with supporting ring 10, a slide valve casing 11 which is pivotably mounted on the assembly plate 9 and has associated arrangements of joint 12 and closure 13 and an entraining casing 15 moved by a worm gear 14 and bearing the discharge block 8.

As shown in FIG. 1, the axis of rotation 16 of the discharge block 8 is inclined to the vertical. The sealing and sliding surfaces 20 of the top block 7 and the discharge block 8 are accordingly inclined to the horizontal.

As also shown in FIG. 1, the axis of rotation 16 of the discharge block 8 and the central axis of the flow channels 17 and 18 of the top block 7 and the discharge block 8 intersect one another in the plane of the outer discharge opening 19 of the flow channel 18 of the discharge block 8 and diverge at an acute angle $\alpha$ of 15 in the direction of the inside of the container. When the discharge block 8 rotates around the axis of rotation 16, the opening of the flow channel 18 of the discharge block 8 bearing against the sliding and sealing surface 20 is guided in the arc of a circle, the flow channel 18 being partially opened or closed, while the discharge opening 19 of the flow channel 18 maintains its position, so that the emerging stream of melt does not shift.

The assembly plate 9, which is formed with an opening 21, is attached to the metal jacket 2 below the opening 4, as shown more particularly in FIG. 3. On its upper side the assembly plate 9 bears the supporting ring 10 which is attached thereto, extending into the opening 4 in the metal jacket 2 and adjoining the refractory bottom block 5.

The closure arrangement 13 comprises a screwthreaded rod 22 having a ball end 23, and a casing 24 having a spring pack and associated adjusting nut 25. The ball end 23 is movably retained by means of a closure plate 27 in a correspondingly constructed opening 26 at the edge of the assembly plate 9.

As FIG. 1 shows, the slide valve casing 11 is annular in construction; on one side it is formed with a recess 28 having a bearing surface 29 for the closure arrangement 13, and on the other side it has a tubular portion 30 receiving a pivot 31 of the joint arrangement 12 which at the same time forms the pivot of the worm gear 14 with worm 32.

As FIG. 2 shows in detail, the pivot 31 is mounted in two lateral bearing lugs 33 of the assembly plate 9. To enable the pivot 31 to perform its double function as a pivoting axis for the joint arrangement 12 and as a pivot for the worm gear 14, disposed on the pivot 31 are two tubular bearings 34 connected by screws via flanges 35 to the tubular portion 30 of the slide valve casing 11; each of them has an external bearing surface 36 for the pivoting movement in the bearing lugs 33, and an inner bearing surface 37 for the rotary movement of the pivot 31 as the driving spindle of the worm gear.

Attached to one bearing lug 33 is a connecting member 38 having a flange 39; a drive motor 40 with a step-down transmission is attached via a counter flange 41 to the flange 39. The end of the pivot 31 extending into the connecting member 38 is connected via a coupling member 43 to the shaft end of the driving shaft 42 of the drive motor 40. To ensure assembly, as shown in FIG. 3, the bearing lugs 33 and the connecting member 38 are open at the side. A helical locking device locks the bearings 34 in the bearing lugs 33.

FIG. 1 shows how the refractory top block 7, which has a binding ring, is disposed in the supporting ring 10. Its surface 44 in the direction of the interior of the vessel bears against the bearing surface 43 of the supporting ring 10. Its sealing and sliding surface 20 is inclined to the horizontal H by an angle of 15°. A pin 47 retained in the supporting ring 10 and engaging in a bore 48 in the top block 7 retains the top block 7 fixed.

The refractory discharge block 8 is disposed in the entraining casing 15, which is annular in construction. Its peripheral surface 49 is spherical in the upper portion below the sealing and sliding surface 20. The inner surface 50 of the entraining casing 15, which bears the discharge block 8, is correspondingly hollow and spherical. This ensures that when the slide valve casing 11 is closed, if any deviations in dimensions due to manufacture occur, the discharge block 8 ca adjust itself in the spherical guide and bear via its sliding and sealing surface 20 sealing-tight against the corresponding surface of the top block 7.

The entraining casing 15 is pivotably mounted in the slide valve casing 11. To this end the entraining casing 15 has an outer crowned portion 51. A corresponding trough-shaped slide ring 52 disposed on the inside wall 53 of the slide valve casing 11 acts as a sliding bearing for the rotary movement of the entraining casing 15.

For the rotation of the entraining casing 15 it has a toothed rim 54, the worm 32 on the pivot 31 of the worm gear 14 meshing with the toothed rim 54.

FIG. 1 also shows how the entraining casing is formed on the inside and in the upper portion with recesses 55 into which projections 56 on the discharge block 8 engage. This prevents the discharge block 8 from sliding in the entraining casing 15 when such block rotates.

For closing the slide valve casing 11, the screwthreaded rod 22 is pushed with the casing 24 disposed thereon into the recess 28 in the casing 11. The casing 24 with the spring pack disposed therein bears against the bearing surface 29. Then the operator tightens the associated adjusting screw 25 on the screwthreaded rod 22, using a moment spanner, until the adjusted force of contact pressure has been reached between the sliding and sealing surfaces 20 of the top block 7 and the discharge block 8.

FIG. 4 shows an embodiment of the pair of refractory blocks according to the invention, wherein an annular insert 57 is disposed in the zone of the discharge opening 19 of the flow channel 18 of the discharge block 8. To this end the flow channel 18 is formed with a recess 58 whose diameter is slightly larger than the external diameter of the annular insert 57. The annular insert 57 is secured in the recess by a suitable glue. The internal diameter of the annular insert 57 is selected in accordance with the required flow quantity of the metal melt to be cast. This feature simplifies production, since there is no longer any need to produce the top block and the discharge block with flow channels of different sizes.

FIG. 4 also shows how the top block 7 advantageously has a metallic binding ring 59, the discharge block 8 having a metallic envelope 60, the ring 59 and the envelope 60 prolonging the service life of the top block and the discharge block.

An engineer in the art can gather from this description of the embodiment the advantages of the pair of refractory blocks according to the invention, attention being drawn again more particularly to the following advantages:

1. Due to its adjustability, the rotary discharge block reliably bears evenly against the top block retained fixed, even if the refractory members show dimensional deviations due to manufacture.

2. The rotary discharge block has a shortened length, the result being a rotary slide valve closure of reduced overall height; due to the frequent lack of space found with such vessels, therefore, the closure is particularly suitable for the intermediate vessel of a continuous casting installation; since the emerging stream of melt does not shift, even narrow continuous casting chill moulds can be reliably filled. The same thing applies to the filling of casting mould pouring gates, if the closure is used for ladles in foundries.

3. The enlarged angle $\alpha$ by which the axis of rotation of the discharge block is inclined to the vertical central axis of the flow channel, and the corresponding inclination of the sliding and sealing surface of the pair of refractory blocks to the horizontal result in optimum sliding and sealing properties between the top block and the discharge block.

I claim:

1. A refractory block arrangement for a rotary slide valve closure for metal melt containers having a bottom discharge, the rotary slide valve closure including a pivotable and closable slide valve casing, said arrangement comprising a refractory top block having a flow channel with a vertical axis, a refractory rotatable frustoconical discharge block having a discharge flow channel having a vertical central axis coincident with the vertical axis of said flow channel of said top block, said discharge flow channel having a discharge opening, and said refractory rotatable frustoconical discharge block also having an axis of rotation extending at an acute angle to the vertical central axis of the discharge flow channel and intersecting the vertical central axis at a point lying in a cross-sectional plane of said discharge opening; and a drivable annular entraining casing rotatably supported in the slide valve casing of the rotary slide valve closure for supporting said frustoconical discharge block, said refractory top block having a sealing and sliding surface inclined to a horizontal and said frustoconical discharge block having another sealing and sliding surface engaging said sealing and sliding surface of said refractory top block, said frustoconical discharge block having a spherically-shaped peripheral surface portion disposed on an upper portion of said frustoconical discharge block below said sealing and sliding surface of said frustoconical discharge block, and said drivable entraining casing having a plurality of recesses, said spherically-shaped peripheral surface portion of said discharge block having a plurality of projections engaging in said recesses, so that said frustoconical discharge block engages with said entraining casing.

2. A refractory block arrangement as set forth in claim 1, wherein said refractory top block is cylindrical and has a bore for receiving a locking pin carried by the rotary slide valve closure.

3. A refractory block arrangement as set forth in claim 1 wherein an angle between the axis of rotation of said discharge block and the vertical central axis of said discharge flow channel and another angle between said sealing and sliding surfaces and the horizontal each is from 15° to 45°.

4. A refractory block arrangement as set forth in claim 1, wherein said frustoconical discharge block has an annular insert in the vicinity of said discharge opening.

5. A refractory block arrangement for a rotary slide valve closure for metal melt containers having a bottom discharge, the rotary slide valve closure including a pivotable and closable slide valve casing, said arrangement comprising a refractory top block having a flow channel with a vertical axis, a refractory rotatable frustoconical discharge block having a discharge flow channel having a vertical central axis coincident with the vertical axis of said flow channel of said top block, said discharge flow channel having a discharge opening, and said refractory rotatable frustoconical discharge block also having an axis of rotation extending at an acute angle to the vertical central axis of the discharge flow channel and intersecting the vertical central axis at a point lying in a cross-sectional plane of said discharge opening; and a drivable annular entraining casing rotatably supported in the slide valve casing of the rotary slide valve closure for supporting said frustoconical discharge block, said frustoconical discharge block having a spherically-shaped peripheral surface portion engaging said annular entraining casing, said refractory top block having a sealing and sliding surface inclined to a horizontal, said frustoconical discharge block having another sealing and sliding surface engaging said sealing and sliding surface of said refractory top block, said spherically-shaped peripheral surface portion being disposed in an upper portion of said discharge block below said sealing and sliding surface of said discharge block, said entraining casing being provided with a plurality of recesses, said spherically-shaped peripheral surface portion having a plurality of projections engaging in said recesses, an angle between the axis of rotation of said discharge block and the vertical central axis of said discharge flow channel and another angle between said sealing and sliding surfaces and the horizontal each being from about 15° to 45°.

* * * * *